United States Patent [19]

Bessinger

[11] Patent Number: 4,736,919

[45] Date of Patent: Apr. 12, 1988

[54] RESILIENT THREADED RETENTION GLASS SHELF BRACKET

[75] Inventor: Walter L. Bessinger, Grand Haven, Mich.

[73] Assignee: Knape & Vogt Manufacturing Company, Grand Rapids, Mich.

[21] Appl. No.: 29,134

[22] Filed: Mar. 23, 1987

[51] Int. Cl.[4] ..... A47G 29/02

[52] U.S. Cl. ..... 248/250; 108/152; 211/90

[58] Field of Search ..... 248/235, 250, 231.7; 211/90; 108/152, 27, 28; 312/128

[56] References Cited

U.S. PATENT DOCUMENTS

| | | | |
|---|---|---|---|
| 564,519 | 7/1896 | Heysinger . | |
| 1,067,850 | 7/1913 | Warner | 248/250 |
| 1,835,935 | 12/1931 | Dean | 248/231.7 X |
| 1,867,276 | 7/1932 | McIntyre | 248/231.7 |
| 2,477,771 | 8/1949 | Sanford | 248/250 X |
| 3,034,757 | 5/1962 | Suben . | |
| 3,949,880 | 4/1976 | Fortunato | 248/231.7 X |
| 4,375,565 | 5/1983 | Roberts et al. . | |
| 4,508,301 | 4/1985 | Nicholson et al. . | |

FOREIGN PATENT DOCUMENTS

| | | | |
|---|---|---|---|
| 811370 | 8/1951 | Fed. Rep. of Germany . | |
| 1534744 | 1/1963 | Fed. Rep. of Germany . | |
| 1400793 | 3/1963 | Fed. Rep. of Germany . | |
| 2749477 | 11/1977 | Fed. Rep. of Germany . | |
| 258041 | 9/1926 | United Kingdom | 211/90 |
| 2155310 | 9/1985 | United Kingdom . | |

*Primary Examiner*—J. Franklin Foss

*Attorney, Agent, or Firm*—Price, Heneveld, Cooper, DeWitt & Litton

[57] ABSTRACT

A support bracket for supporting in a cantilever fashion a glass or marble shelf has a laterally oriented throat to receive the rear portion of a shelf panel and an adjustment screw extending from the throat bottom to bias the shelf rear portion into restraining engagement with a support surface on the throat top. Cushioning means are provided in association with the adjustment screw to distribute the biasing force of the screw uniformly over an area of the shelf surface. In some embodiments the cushioning means is a separate resilient member between the screw and a shelf and in other embodiments the screw is made of a polymeric material to provide the cushioning means.

5 Claims, 1 Drawing Sheet

RESILIENT THREADED RETENTION GLASS SHELF BRACKET

BACKGROUND OF THE INVENTION

This invention relates to shelf support brackets and in particular to brackets of the type that support glass and marble shelf panels in a cantilevered fashion.

Cantilever shelf brackets for supporting inserted shelf panels, usually of wood, have been known for many years. In recent years, these have taken the form of extruded aluminum devices capable of receiving the shelf panel in a wedging action, as in U.S. Pat. Nos. 4,508,301 and 4,385,565. That is, the wood shelf panel of closely controlled thickness tolerance is placed under slightly deforming wedging stress during insertion, for secure retention of the assembled panel structure. While this works very well for certain materials such as wood or particle board, it is not desirable to apply such stresses to certain other materials particularly glass or marble. Breakage can result. This potential breakage problem is accentuated by the fact that glass panels for shelving tend to vary considerably in thickness. Therefore, a thicker panel either will not fit within the throat of the bracket or, if sufficient force is applied to wedge it in place, the stress is immediately too great. If a thin panel is inserted, it is not securely retained. Furthermore, the potential of breakage resulting from the stress is increased if any scratching of the glass occurs.

SUMMARY OF THE INVENTION

The primary object of this invention is to provide a cantilever shelf bracket capable of receiving and retaining a shelf panel of glass or marble without scratching, marring or application of localized stress to the panel upon assembly. The support bracket assembly has a laterally oriented throat sufficiently wide to receive the rear portion of shelf panels of a variety of thicknesses. The bracket assembly further has an adjustment screw means extending from a lower support platform to bias an inserted shelf into restraining engagement with a support surface on the throat top. Cushioning means are provided in association with the adjustment screw means to distribute the biasing force of the screw means over an area of the shelf surface to reduce localized stress.

These and other related objects, advantages and features of this invention will become apparent upon review of the following specification in conjunction with the drawings.

DESCRIPTION OF THE PREFERRED EMBODIMENT

Figure 1:
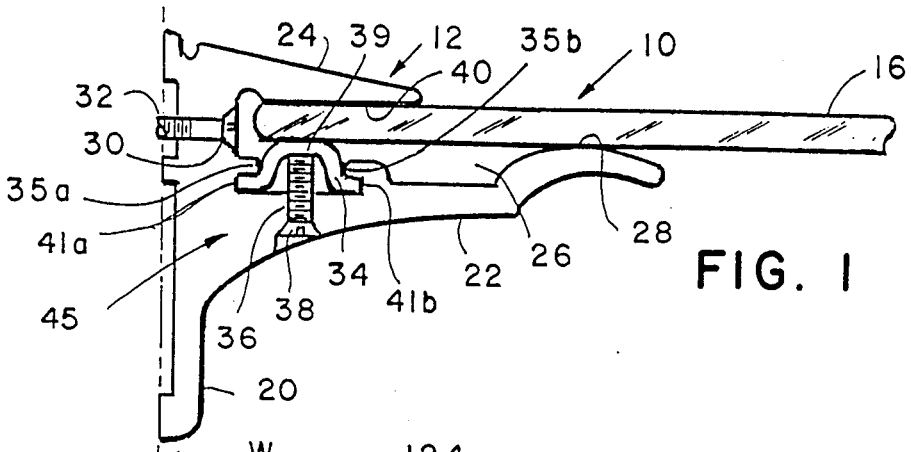
FIG. 1 is a side elevational sectional view of the support bracket assembly according to the invention, shown supporting a glsss shelf panel.

Referring now specifically to the drawings, and the illustrated embodiments depicted therein, the support bracket assembly 10 includes a bracket 12 having a vertical rear panel 20 for attachment to a wall member in a horizontal orientation by fastener screws 32 extending through orifices 30 and into a wall stud: A lower support platform 22 extends rigidly outwardly from the rear panel 20. An outer portion of lower support platform 22 extends upwardly to define an outer support surface 28 which has a large radius downwardly curved surface to support a shelf and a depression or recess between this surface 28 and rear panel 20. An upper support overhang 24 extends rigidly outwardly from vertical rear panel 20 and defines an upper support surface 40 facing downwardly. Upper support overhang 24 and lower support platform 22 define a laterally oriented throat 26 to receive the rear portion of a shelf member 16. Shelf 16 is essentially supported in cantilever fashion by upper support surface 40 and outer support surface 28.

A biasing means, shown generally at 45, is provided to bias the rear portion of shelf panel 16 into firm engagement with upper support surface 40. The biasing means is adjustable to accommodate various thickness panels while providing sufficient biasing engagement with support surface 40 to help to prevent the shelf from accidentally being pulled from the support bracket. To provide such adjustment, a countersunk threaded aperture 36 is formed in lower support platform 22. A threaded adjustment screw 38 is longitudinally adjustably retained in aperture 36 and will function to increase or decrease the biasing force between the shelf panel 16 and upper support surface 40 by rotation of the adjustment screw 38. A flat head screw of preselected length provides some amount of protection against over-tensioning of the glass panel 16, by causing the head of screw 38 to bottom on the countersunk portion of aperture 36 when the screw is fully extended.

An adjustment screw may be capable of exerting very large localized stress on a surface, especially if the screw is fabricated from a hard metal such as steel. In order to distribute the stress more uniformly and over a wider area, a resilient compression boot 34 is provided over an edge 39 of adjustment screw 38 that biases the panel 16 upwardly. Boot 34 is preferably made of a polymeric material such as polyvinylchloride. Boot 34 has a pair of terminating edges **41*a*, 41*b* that are received within flanges 35*a*, 35*b* formed within lower support platform 22. Compression boot 34 could be circular in plan view to cover only one adjustment screw, or, could be elongated the length of the support bracket to cover a plurality of adjustment screws 38**.

To support a glass panel by bracket assembly 12, the adjustment screw 38 is first adjusted to a retracted position. Shelf panel 16 is then inserted into throat section 26 leaving a small gap between the rear edge of the panel and vertical rear panel 20. Adjustment screw 38 is then rotatably extended, biasing panel 16 into contact with support surface 40. Screw 38 is additionally extended until sufficient biasing force is exerted to prevent the panel 16 from being laterally separated from throat 26.

Figure 2:
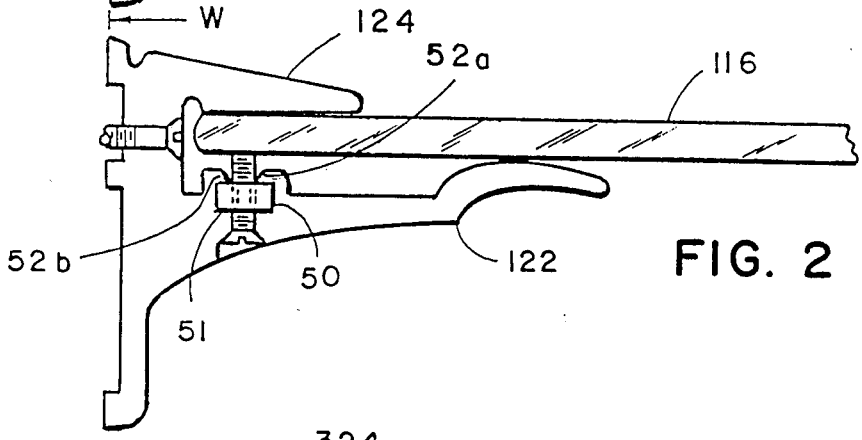
FIG. 2 is an alternative embodiment of the invention shown in FIG. 1.

FIG. 2 shows an alternative embodiment to that shown in FIG. 1. In this embodiment, adjustment screw 138 is formed from a rigid polymeric material, such as Nylon. A countersunk clearance passage 54 is formed in lower support platform 122 to receive screw 138 and a threaded square nut 50 is retained within a recess 51 in lower support platform 122 as by staking or by other known methods. The invention operates essentially the same as the previous embodiment, except that the localized tension on glass plate 116 is distributed uniformly over an area due to the limited resiliency of the edge of polymeric adjustment screw 138 in contact with the panel 116. Therefore, the forming of adjustment screw 138 from a rigid polymeric material provides integral cushioning means associated with the edge of the adjustment screw to distribute the localized tensioning forces.

Figure 3:
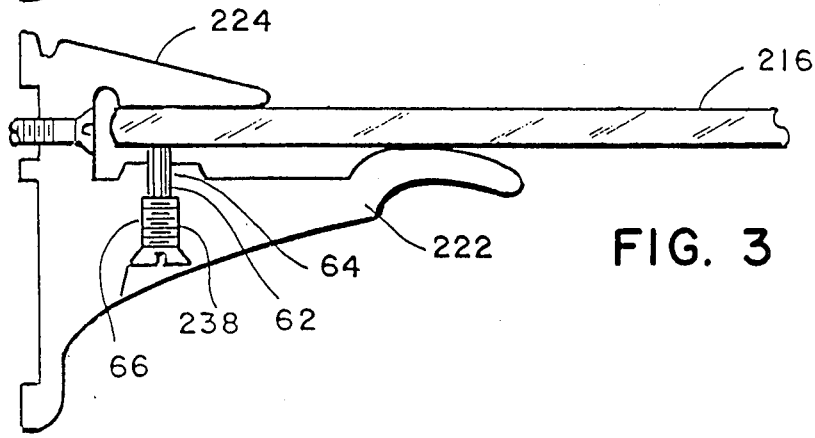
FIG. 3 is another alternative embodiment of the invention shown in FIG. 1.

FIG. 3 discloses another alternative embodiment of the invention. The invention operates similarly to the embodiment shown in FIG. 1, except that, in this embodiment, adjustment screw 238 is confined to operation completely within a countersunk threaded bore 66 in lower support platform 222. The uppermost portion of bore 66 has a reduced diameter and is without threads. A resilient follower 64 of cylindrical shape and formed from a polymeric material such as Nylon is inserted in bore 62. As tension screw 238 is adjusted, the force is transmitted through follower 64 to shelf panel 216. The resilience of the material and the generally flat surface of bore 64 that contacts the shelf panel serves to distribute any stresses uniformly over an area of the shelf panel surface.

Figure 4:
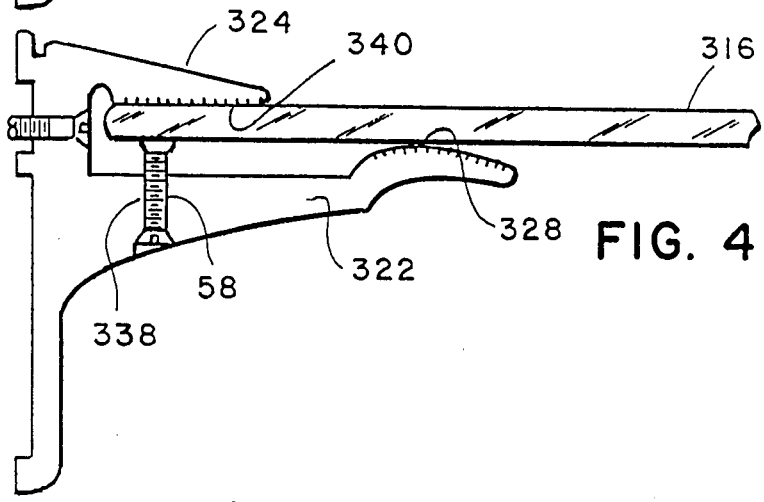
FIG. 4 is yet another alternative embodiment of the invention shown in FIG. 1.

The embodiment shown in FIG. 4 is similar to that in FIG. 2 except the polymeric adjustment screw 338 is longitudinally rotatably extended by interaction with a threaded opening 58 in lower support platform 322. Additionally, in FIG. 4, upper support surface 340 and outer support surface 328 are shown coated by a layer of, latex or polymeric paint. The paint is applied as by a conventional powder coating process that comprises depositing a coat of a latex or polymeric powder on the surfaces and heat curing in an oven to form a film that is bonded to the metal surface. Such latex or polymeric layer increases the friction of the support surfaces to provide greater grip on the shelf panel 316 for a given amount of biasing force from the adjustment screw. In addition, the latex surface provides a limited amount of flexibility to additionally cushion the glass panel to reduce localized stresses in the area of the support surfaces.

The adjustment screws in the illustrated embodiments could also be a headless set screw.

Changes and modifications in the specifically described embodiments can be carried out without departing from the scope of the invention which is intended to be limited only by the scope of the appended claims.

The embodiments of the invention in which an exclusive property or privilege is claimed are defined as follows:

1. A cantilever shelf support for a shelf having a rear portion comprising:

a bracket having a laterally oriented throat to receive the rear portion of a shelf;

said throat having a lower support platform forming a bottom and an upper overhang forming a top support surface;

adjustment screw means for biasing an inserted shelf into lateral restraining engagement with said top support surface, said adjustment screw means extending from said lower support platform toward said top support surface and terminating in an upper edge;

cushioning means associated with said adjustment screw means upper edge for distributing the biasing force of the screw means edge over an area of the shelf surface;

said adjustment screw means comprising edge means defining a threaded opening in said lower support platform and a rigid polymeric threaded screw longitudinally, adjustably retained in said opening and wherein said screw means upper edge defines said cushioning means.

2. The shelf support in claim 1 wherein said outer support means comprises an upwardly extending, downwardly curved surface.

3. A cantilever shelf support for a shelf having a rear portion comprising:

a bracket having a laterally oriented throat to receive the rear portion of a shelf;

said throat having a lower support platform forming a bottom and an upper overhang forming a top support surface;

adjustment screw means for biasing an inserted shelf into lateral restraining engagement with said top support surface, said adjustment screw means extending from said lower support platform toward said top support surface and terminating in an upper edge;

cushioning means associated with said adjustment screw means upper edge for distributing the biasing force of the screw means edge over an area of the shelf surface;

said adjustment screw means comprising edge means defining a threaded opening in said lower support platform and a rigid polymeric threaded screw longitudinally, adjustably retained in said opening and wherein said screw means upper edge defines said cushioning means;

said cushioning means being a flexible polymeric compression boot straddling said screw means edge and having opposite edges retained by a pair of flanges formed in said lower support platform.

4. A cantilever shelf support for a shelf having a rear portion comprising:

a bracket having a laterally oriented throat to receive the rear portion of a shelf;

said throat having a lower support platform forming a bottom and an upper overhang forming a top support surface;

means defining a threaded aperture in said lower support platform;

a screw longitudinally adjustably engaging the threads of said threaded aperture and extending toward said upper overhang, said screw defining a contacting edge;

resilient cushioning means between said contacting edge and an inserted shelf for uniformly distributing biasing forces from said contacting edge over an area of the shelf;

said cushioning means comprising a cylindrical screw follower aligned with said screw and in said aperture.

5. A cantilever shelf support for a shelf having a rear portion comprising:

a bracket having a laterally oriented throat to receive the rear portion of a shelf;

said throat having a lower support platform forming a bottom and an upper overhang forming a top support surface;

means defining a threaded aperture in said lower support platform;

a screw longitudinally adjustably engaging the threads of said threaded aperture and extending toward said upper overhang, said screw defining a contacting edge;

resilient cushioning means between said contacting edge and an inserted shelf for uniformly distributing biasing forces from said contacting edge over an area of the shelf;

said cushioning means comprising a boot over said screw edge having edges received in flanges formed in said lower support platform.

* * * * *